US007976188B2

(12) United States Patent
Peng

(10) Patent No.: US 7,976,188 B2
(45) Date of Patent: Jul. 12, 2011

(54) LED ILLUMINATION DEVICE AND ILLUMINATION MODULE USING THE SAME

(75) Inventor: Chang-Hung Peng, Chung-Ho (TW)

(73) Assignee: Cooler Master Co., Ltd., Taipei (TW)

( * ) Notice: Subject to any disclaimer, the term of this patent is extended or adjusted under 35 U.S.C. 154(b) by 399 days.

(21) Appl. No.: 12/061,115

(22) Filed: Apr. 2, 2008

(65) Prior Publication Data

US 2009/0147510 A1 Jun. 11, 2009

(30) Foreign Application Priority Data

Dec. 7, 2007 (TW) ..... 96220825 U

(51) Int. Cl.
*F21V 21/00* (2006.01)

(52) U.S. Cl. ..... 362/249.02; 362/294; 362/373; 362/265; 362/221; 362/646

(58) Field of Classification Search ..... 362/97.3, 362/240, 249.02, 311.02, 373, 365, 221, 362/646

See application file for complete search history.

(56) References Cited

U.S. PATENT DOCUMENTS

| | | | | |
|---|---|---|---|---|
| 4,138,716 | A * | 2/1979 | Muhlethaler et al. | 362/375 |
| 4,158,223 | A * | 6/1979 | Walley et al. | 362/297 |
| 7,160,008 | B2 * | 1/2007 | Pan | 362/497 |
| 7,431,475 | B2 * | 10/2008 | Hafuka et al. | 362/218 |
| 2007/0115666 | A1 * | 5/2007 | Thomas et al. | 362/294 |
| 2007/0258266 | A1 * | 11/2007 | Baek et al. | 362/612 |
| 2008/0055908 | A1 * | 3/2008 | Wu et al. | 362/294 |
| 2009/0097264 | A1 * | 4/2009 | Dunn | 362/373 |

* cited by examiner

*Primary Examiner* — Evan Dzierzynski
(74) *Attorney, Agent, or Firm* — Chun-Ming Shih; HDLS IPR Services

(57) ABSTRACT

A LED illumination device includes a base plate, a plurality of LEDs, a driving circuit and a control circuit. The plurality of LEDs, the driving circuit and the control circuit are arranged on a surface of the base plate and electrically connected to each other. The control circuit is configured for controlling the driving circuit to output a driving power. The plurality of LEDs emit light based upon the driving power. Thus the base plate, the LEDs, the driving circuit and the control circuit are integrated in a same device for simplifying the whole structure thereof to be easily assembled.

12 Claims, 9 Drawing Sheets

LED ILLUMINATION DEVICE AND ILLUMINATION MODULE USING THE SAME

BACKGROUND

1. Field of the Invention

The present invention relates to an illumination device, and more specifically, to a LED illumination device and an illumination module adapting the same.

2. Description of the Related Art

With the development of the modern illumination technology, light emitting diode (LED) is an important light source and is developed rapidly. LED is a low voltage element, driven by a direct current, easily adjusted, and cooperates with a control circuit with a low cost. Furthermore, LED has a small volume and various shapes, which fit needs of intending illumination devices in lightweight, small size, and thin thickness.

Referring to FIG. 1, a typical LED illumination device is provided. The typical LED illumination device includes a lamp holder a, a driving circuit b and a control circuit c. The lamp holder a includes a plurality of LEDs a1, a heat-dissipating body a2 connected to the back thereof. The heat-dissipating body a2 is configured for dissipating heat generated from the plurality of LEDs a1. The lamp holder a, the driving circuit b and the control circuit c are electrically connected to each other through leads. The driving circuit b and the control circuit c of the LED illumination device are not fixed on the lamp holder a, thus they should be fixed in additional steps when assembling the LED illumination device. Therefore, the typical LED illumination device is inconvenient in assembly. Furthermore, since the driving circuit b and the control circuit c is arranged out of the lamp holder a, they are trended to be affected with damp to be damaged if without waterproof process. The leads configured for electrically connecting the lamp holder a, the driving circuit b and the control circuit c, are exposed, therefore, they are easily damaged to produce poor contacts. Since the driving circuit b, the control circuit c and the lamp holder a are electrically connected in a predetermined mode, the driving circuit b and the control circuit c will be greatly changed if adding more holders a. Further, the lamp holders a are difficulty arranged in series or in parallel.

What is needed is providing a LED illumination device, which can solve the above problems.

BRIEF SUMMARY

A LED illumination device in accordance with an exemplary embodiment of the present invention includes a base plate, a plurality of LEDs, a driving circuit and a control circuit. The plurality of LEDs, the driving circuit and the control circuit are arranged on a surface of the base plate and electrically connected to each other. The control circuit is configured for controlling the driving circuit to output a driving power. The plurality of LEDs emit light based upon the driving power.

Preferably, the LED illumination device further includes a heat-dissipating body arranged on an opposite surface of the base plate. The heat-dissipating body includes a plurality of heat sinks having a through hole defined therein. A groove is defined in the surface of the base plate, where the heat-dissipating body is arranged on. The LED illumination device further includes a heat pipe having a heat-absorbing portion and a heat-dissipating portion extending from the heat-absorbing portion. The heat-absorbing portion is contained in the groove, and the heat-dissipating portion passes through the through hole of the heat sinks.

An illumination module having LED illumination devices in accordance with another exemplary embodiment of the present invention is provided. The LED illumination devices are arranged in series or in parallel through fixed arms and a connecting unit.

An illumination module having LED illumination devices in accordance with other exemplary embodiment of the present invention includes a plurality of LED illumination devices, a plurality of fixed arms and a connecting unit. The plurality of LED illumination devices are arranged in a direction. Each LED illumination device includes a base plate, a plurality of LEDs, a driving circuit and a control circuit. The plurality of LEDs, the driving circuit and the control circuit are arranged on a surface of the base plate and electrically connected to each other. The control circuit is configured for controlling the driving circuit to output a driving power, and the plurality of LEDs emit light based upon the driving power. The plurality of fixed arms are arranged respectively on two opposite ends of the base plate of each LED illumination device. The connecting unit is connected with the plurality of fixed arms.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Reference will now be made to the drawings to describe exemplary embodiments of the present LED illumination device, in detail. The following description is given by way of example, and not limitation.

Figure 1:
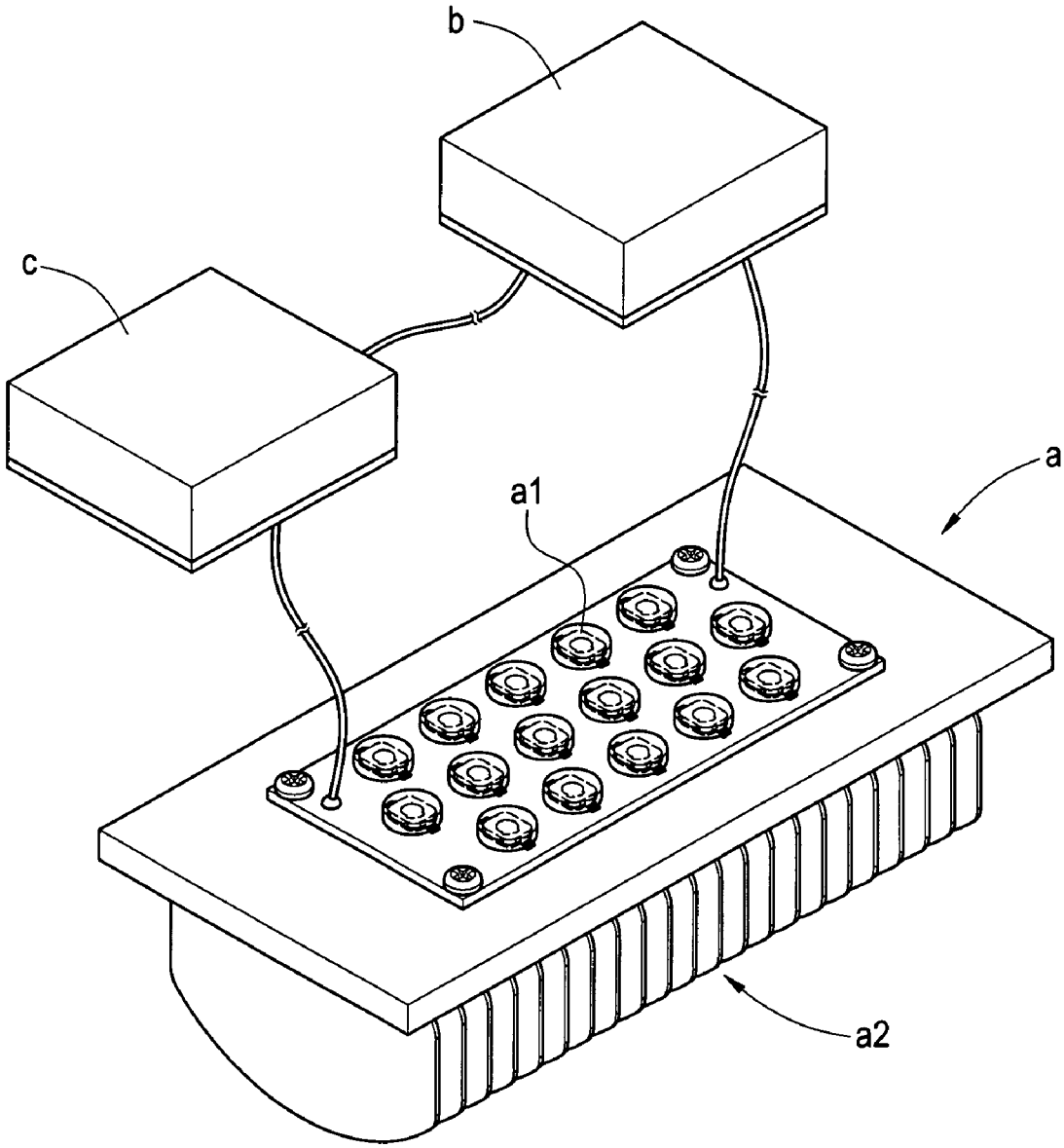
FIG.1 PRIOR ART
FIG. 1 is a schematic, perspective view of a LED illumination device, in accordance with a first exemplary embodiment of the present invention.
Figure 2:
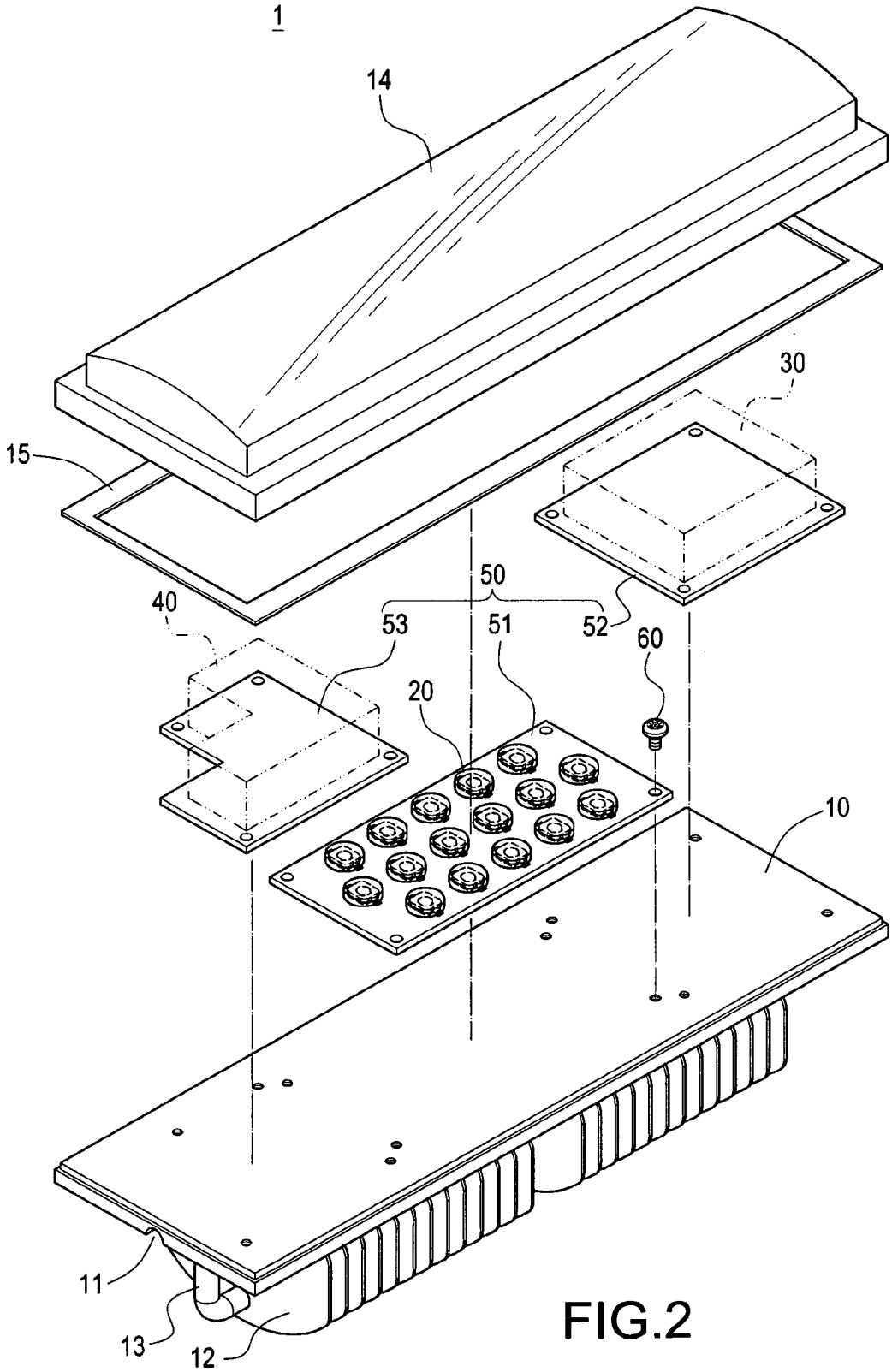
FIG. 2 is a schematic, exploded perspective view of the LED illumination device of FIG. 1.
Figure 3:
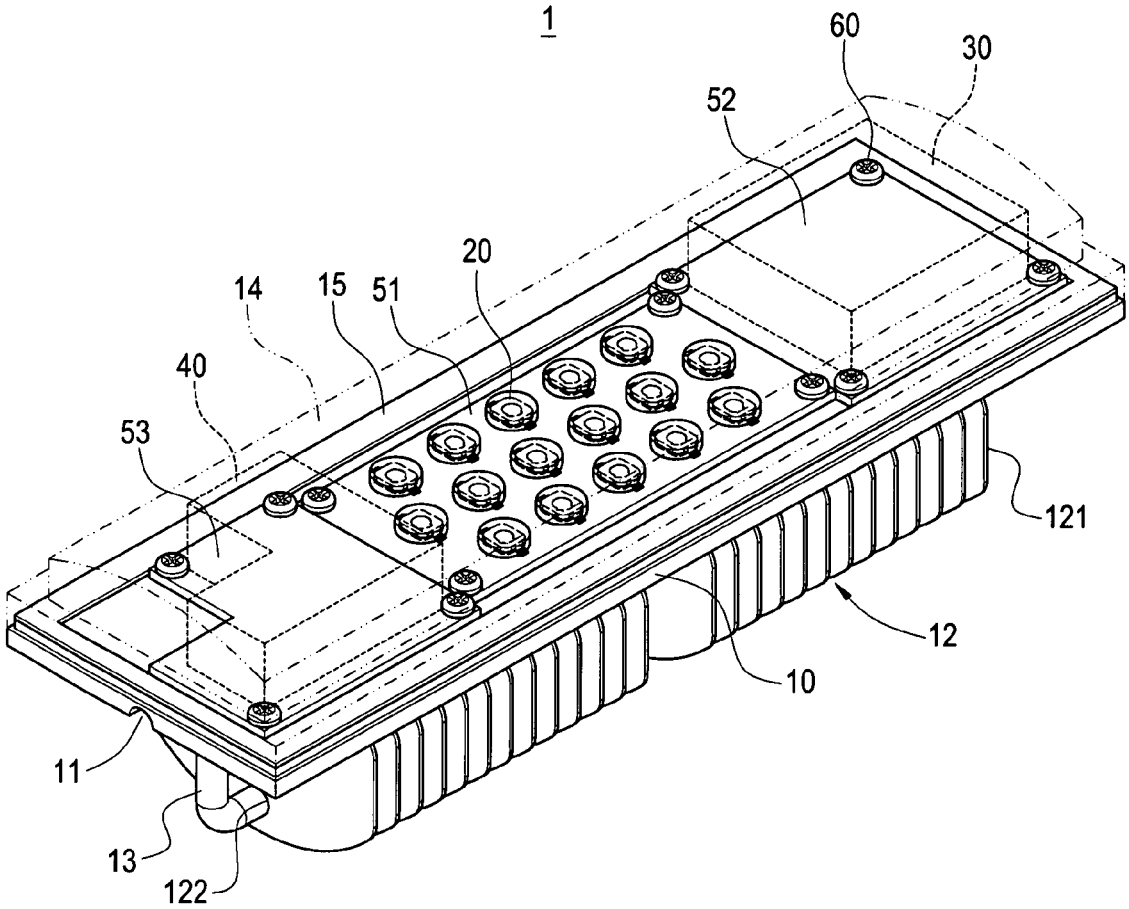
FIG. 3 is a schematic, combined view of the LED illumination device of FIG. 2.
Figure 4:
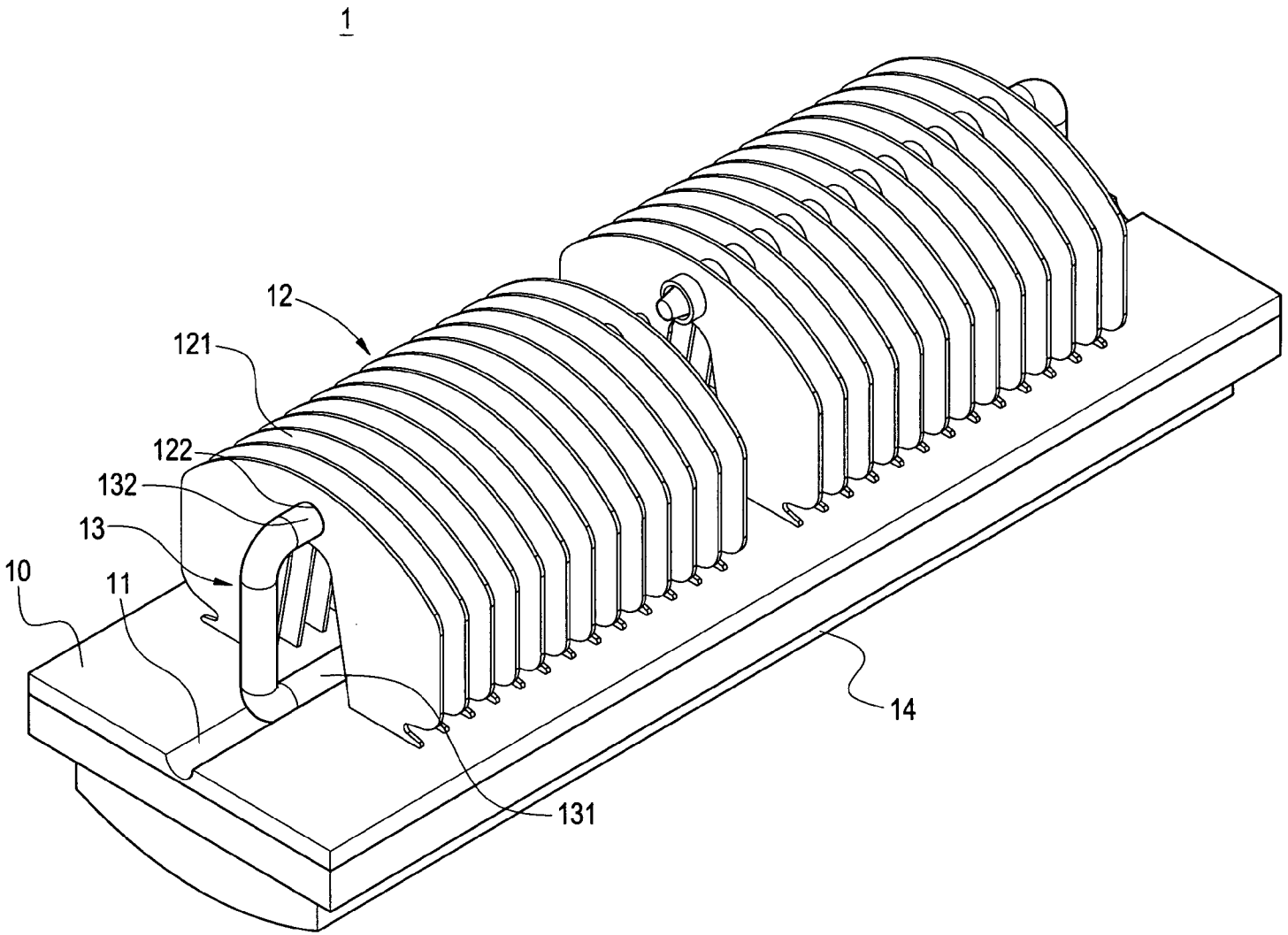
FIG. 4 is a schematic, combined view of the LED illumination device in another view.

Referring to FIGS. 2-4, a LED illumination device 1, in accordance with a first exemplary embodiment of the present invention, is provided. The LED illumination device 1 includes a base plate 10, a plurality of LEDs 20, a driving circuit 30 and a control circuit 40. The plurality of LEDs 20, the driving circuit 30 and the control circuit 40 are all arranged on a surface of the base plate 10, and the LEDs 20, the driving circuit 30 and the control circuit 40 are electrically connected to each other. The control circuit 40 is configured for controlling the driving circuit 30 and driving the driving circuit 30 to output a driving power. The LEDs 20 emit light based upon the driving power.

The LED illumination device 1 may further includes a heat-dissipating body 12 and a heat pipe 13 arranged on an opposite surface of the base plate 10. A groove 11 is defined on the base plate 10. The heat-dissipating body 12 is composed of a plurality of heat sinks 121, each being spaced from another. Each heat sink 121 has a corresponding through hole 122 defined therein. The heat pipe 13 includes a heat-absorbing portion 131 and a heat-dissipating portion 132, the heat-absorbing portion 131 is contained in the groove 11, and the heat-dissipating portion 132 passes through the through holes 122 thereof.

In this exemplary embodiment, the LED illumination device 1 further includes a lampshade 14 and a waterproof gasket 15. The lampshade 14 is configured for covering the LEDs 20, the driving circuit 30 and the control circuit 40 on the base plate 10. The waterproof gasket 15 is arranged between the lampshade 14 and the base plate 10 for preventing hydrosphere into an inner space defined between the lampshade 14 and the base plate 10, such that the inner elements (the LEDs 20, the driving circuit 20 and the control circuit 30) therein are not trended to be damaged.

Since the heat-absorbing portion 131 of the heat pipe 13 is contained in the groove 11 of the base plate 10, heat generated from the LEDs 20, the driving circuit 30 and the control circuit 40, are transmitted to the base plate 10 and absorbed by the heat-absorbing portion 131. Then the heat are transmitted to the heat sinks 121 through the heat-dissipating portion 132, and dissipated by the heat sinks 121.

The LED illumination device 1 may further includes a circuit board 50. In this exemplary embodiment, the circuit board 50 includes a first circuit board 51, a second circuit board 52 and a third circuit board 53 arranged on the base plate 10 respectively. The LEDs 20 are arranged on the first circuit board 51. The driving circuit 30 is arranged on the second circuit board 52, and the control circuit 40 is arranged on the third circuit board 53. The first circuit board 51, the second circuit board 52 and the third circuit board 53 are fixed respectively on the base plate 10 by fastening elements 60. The fastening elements 60 may be screws.

Figure 5:
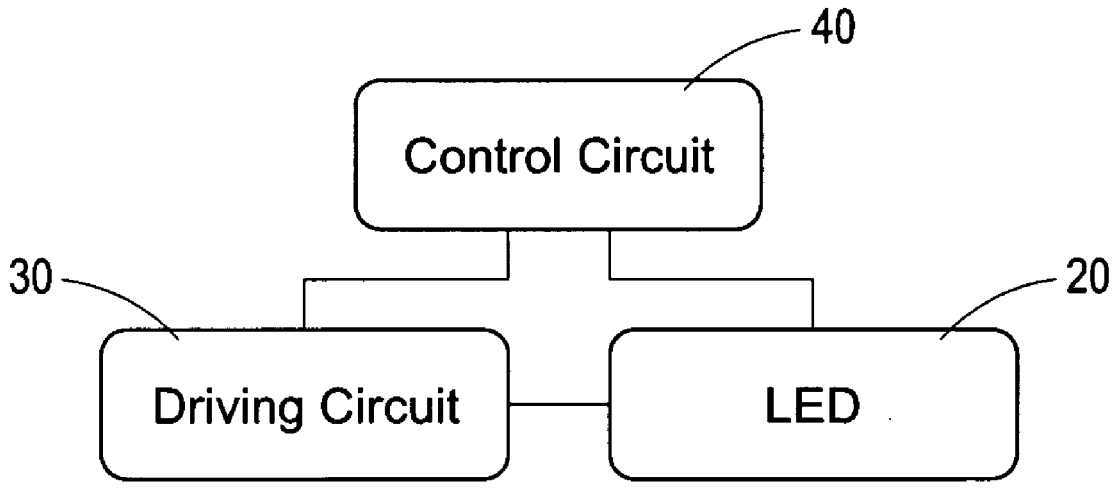
FIG. 5 is a schematic, circuit diagram of the LED illumination device.

Referring to FIG. 5, a circuit diagram of the present illumination device 1 is shown. The luminous intensity of each LED 20 is direct proportional to the driving current passing through each LED 20, thus, little voltage change will greatly effect the luminous intensity of each LED 20. The driving circuit 30 is configured for sending out a steady driving power to each LED 20, such that each LED 20 has a steady luminous intensity. The control circuit 40 is configured for controlling the driving circuit 30 to output the steady driving power for each LED 20.

Figure 6:
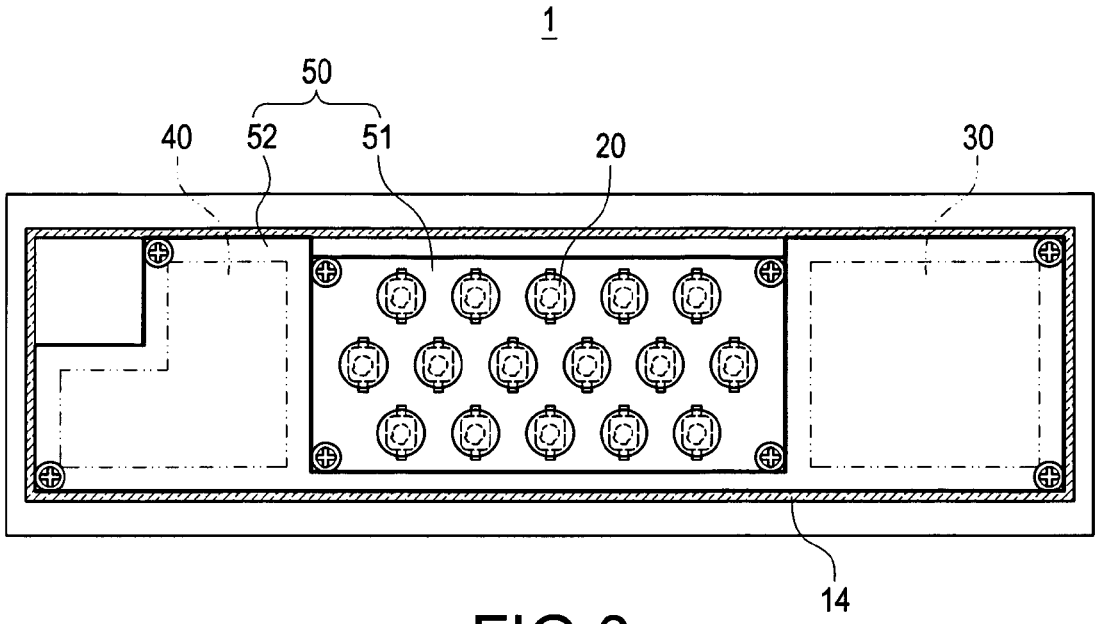
FIG. 6 is a schematic, top view of a LED illumination device, in accordance with a second exemplary embodiment of the present invention.

Referring to FIG. 6, a LED illumination device in accordance with a second exemplary embodiment of the present invention, is provided. In this exemplary embodiment, the circuit board 50 includes a first circuit board 51 and a second circuit board 52. The first circuit board 51 and the second circuit board 52 are respectively arranged on the base plate 10. The LEDs 20 are arranged on the first circuit board 51, and the driving circuit 30 and the control circuit 40 are arranged on the second circuit board 52. Therefore, the optical device (the LEDs 20) and the electronic device (the driving circuit 30 and the control circuit 40) are respectively assembled, and the illumination device is manufactured conveniently.

Figure 7:
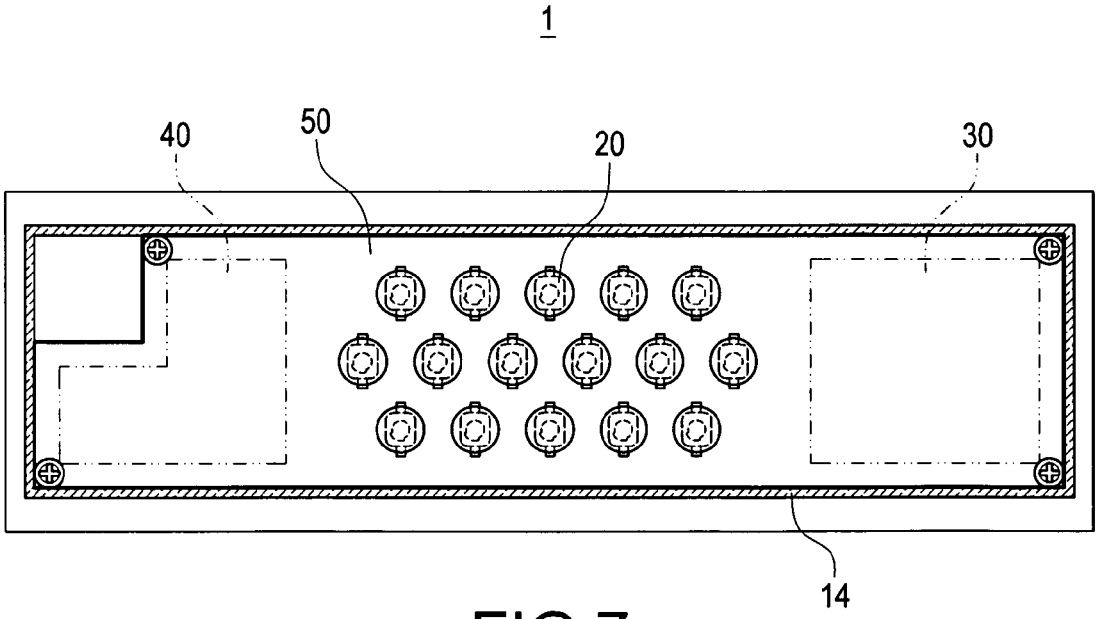
FIG. 7 is a schematic, top view of a LED illumination device, in accordance with a third exemplary embodiment of the present invention.

Referring to FIG. 7, a LED illumination device in accordance with a third exemplary embodiment of the present invention, is provided. In this exemplary embodiment, the circuit board 50 is a single board and arranged on the base plate 10. The LEDs 20, the driving circuit 30 and the control circuit 40 are all arranged on the circuit board 50. Thus it will save manufacturing steps and time for assembling the LEDs 20, the driving circuit 30 and the control circuit 40 on the base plate 10.

Figure 8:
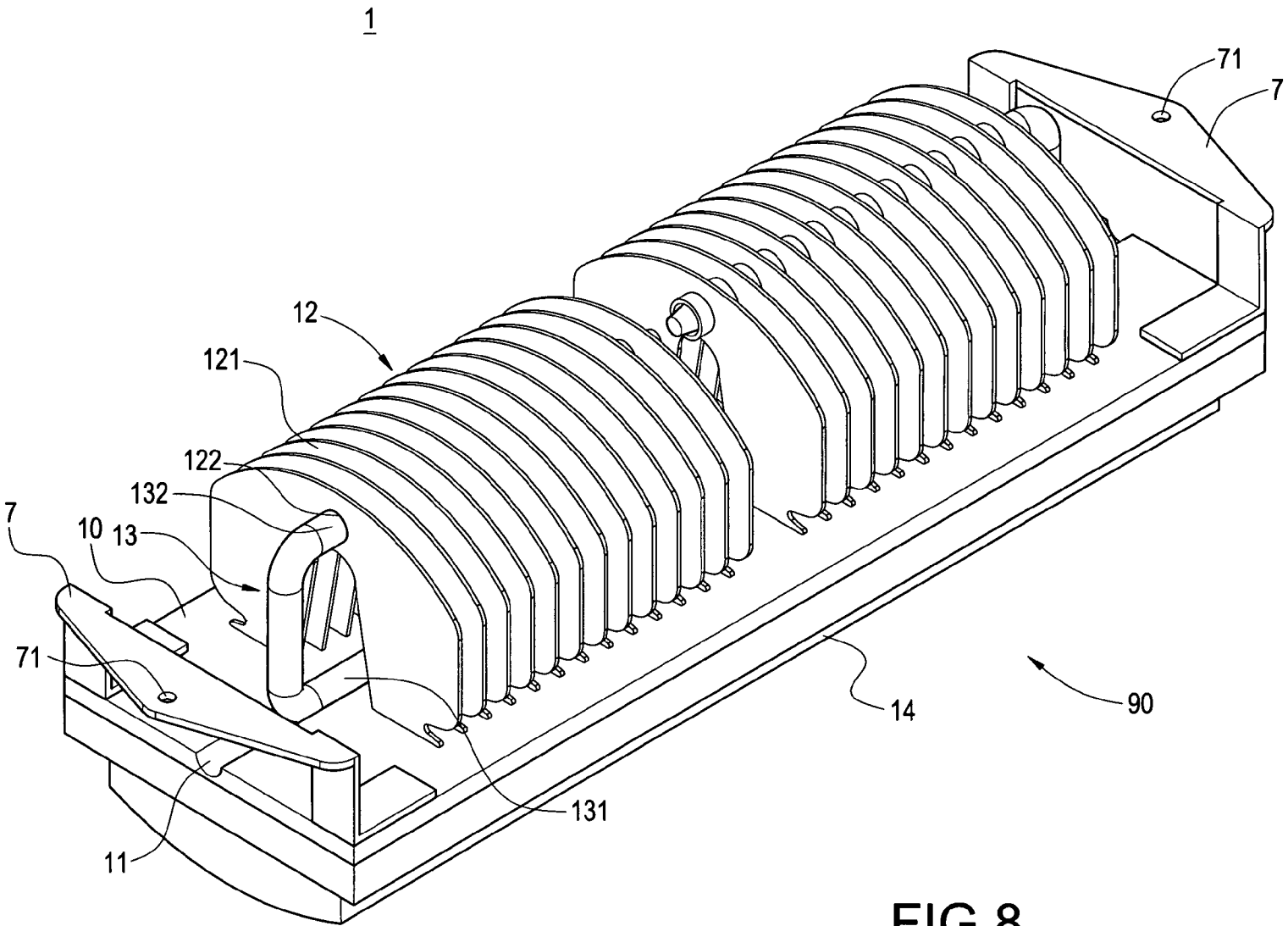
FIG. 8 is a schematic, perspective view of an illumination module having the LED illumination device cooperating with fixed arms.
Figure 9:
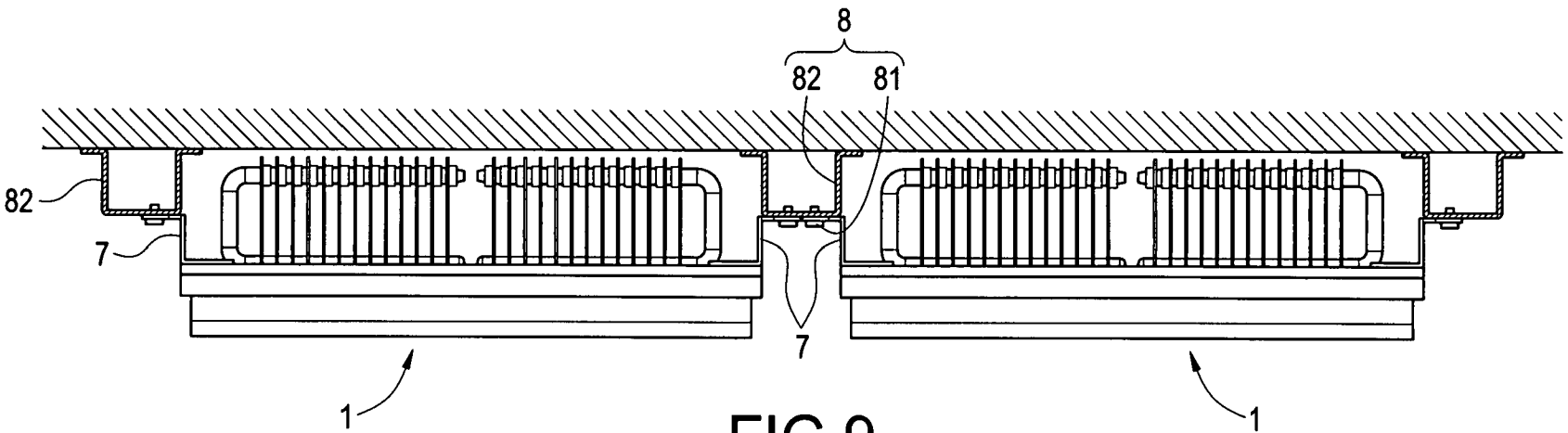
FIG. 9 is a schematic, side view of the illumination device having a plurality of LED illumination devices in series.
Figure 10:
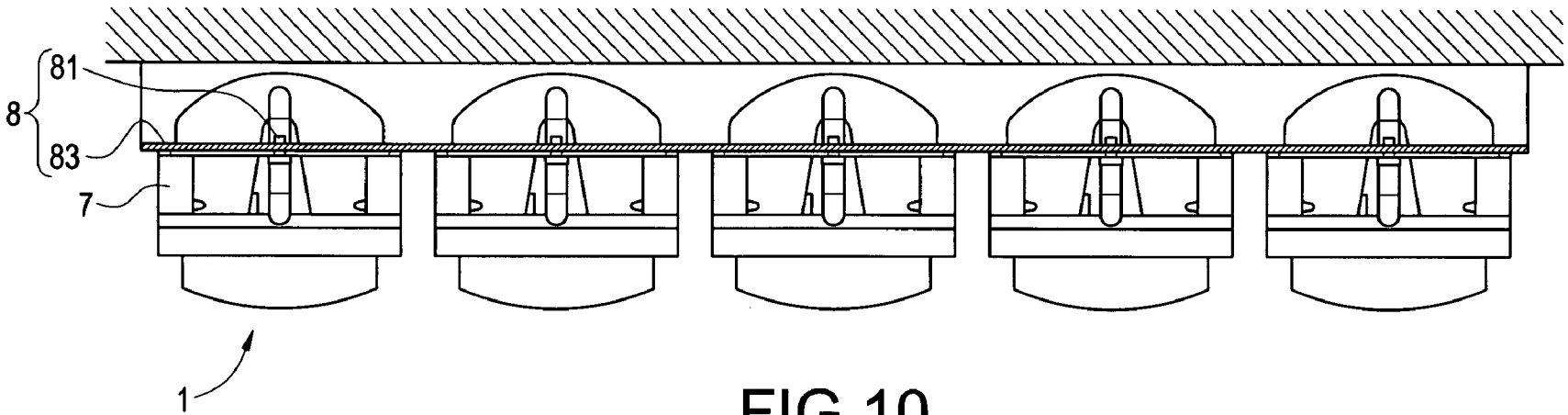
FIG. 10 is a schematic, side view of the illumination device having a plurality of LED illumination devices in parallel.

Referring to FIGS. 8-10, an illumination module having the LED illumination device, in accordance with a fourth exemplary embodiment, is provided. The illumination module mainly includes a plurality of LED illumination devices 1, a plurality of fixed arms 7 and a connecting unit 8 (as shown in FIG. 9). The fixed arms 7 are respectively arranged on two ends (the front end and the rear end) of the base plate 10 of each LED illumination device 1. Each fixed arm 7 may be a Z-shaped plate. Of course, each fixed arm 7 is not limited in the Z-shaped plate, and it may be other shape or structure. A through hole 71 is defined in the center of each fixed arm 7. The connecting unit 8 may be a screw (not shown in FIG. 8) passing through the through holes 71 of two adjacent fixed arms 7 for connecting the two adjacent fixed arms 7. In FIG. 9, the short sides of the LED illumination devices 1 are arranged in parallel and in a longitudinal direction, the connecting unit 8 includes two screws 81 and a U-shaped plate 82. The U-shaped plate 82 is arranged on two adjacent fixed arms 7 of two adjacent LED illumination devices 1 and fixed thereon by the two screws 81. Thus the two adjacent LED illumination devices 1 are arranged in series. In FIG. 10, the long sides of the LED illumination devices 1 are arranged in parallel and in a transverse direction. The connecting unit 8 includes a plurality of screws 81 and a flat plate 83. Each fixed arm 7 is fixed on the flat plate 83 by the corresponding screw 81, such that the LED illumination devices 1 are arranged in parallel for greatly increasing the illumination regions or areas thereof.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A light emitting diode (LED) illumination lamp device, comprising:

a base plate;

a circuit board arranged on a first surface of the base plate;

a heat-dissipating body arranged on a second surface opposite to the first surface of the base plate, the heat-dissipating body including a plurality of heat sinks, each of the plurality of heat sinks having a through hole defined therein, a groove being defined on the second surface, and a heat pipe having a heat-absorbing portion being contained in the groove and a heat-dissipating portion passing through the through hole of each of the plurality of heat sinks;

a plurality of LEDs;

a driving circuit; and a control circuit;

wherein the plurality of LEDs, the driving circuit and the control circuit are arranged on the circuit board and electrically connected to each other, the control circuit is configured for controlling the driving circuit to output a driving power, and the plurality of LEDs emitting light based upon the driving power, thereby heat generated from the LEDs, the driving circuit and the control circuit are transmitted to the base plate and absorbed by the heat-absorbing portion, then the heat are transmitted to the heat sinks through the heat-dissipating portion and dissipated by the heat sinks, wherein the circuit board is composed of a first circuit board and a second circuit board, the plurality of LEDs being arranged on the first circuit board, and the driving circuit and the control circuit being arranged on the second circuit board.

2. The LED illumination lamp device as claimed in claim 1, further comprising a lampshade configured for covering the plurality of LEDs, the driving circuit and the control circuit on the base plate.

3. The LED illumination lamp device as claimed in claim 2, further comprising a waterproof gasket arranged between the lampshade and the base plate.

4. The LED illumination lamp device as claimed in claim 1, wherein the circuit board is composed of the first circuit board, the second circuit board and a third circuit board, the plurality of LEDs being arranged on the first circuit board, the driving circuit being arranged on the second circuit board, and the control circuit being arranged on the third circuit board.

5. The LED illumination lamp device as claimed in claim 1, further comprising a fixed arm, one end of the fixed arm being arranged and fixed on the base plate, and another opposite end of the fixed arm having a through hole defined therein.

6. An illumination module, comprising:

a plurality of light emitting diode (LED) illumination lamp devices arranged in a longitudinal direction, each of the plurality of LED illumination devices including:

a base plate, a circuit board arranged on a first surface of the base plate, a heat-dissipating body arranged on a second surface opposite to the first surface of the base plate, the heat-dissipating body including a plurality of heat sinks, each of the plurality of heat sinks having a through hole defined therein, a groove being defined on the second surface, and a heat pipe having a heat-absorbing portion being contained in the groove and a heat-dissipating portion passing through the through hole of each of the plurality of heat sinks, a plurality of LEDs, a driving circuit and a control circuit, the plurality of LEDs, the driving circuit and the control circuit being arranged on the circuit board and electrically connected to each other, the control circuit being configured for controlling the driving circuit to output a driving power, and the plurality of LEDs emitting light based upon the driving power, thereby heat generated from the LEDs, the driving circuit and the control circuit are transmitted to the base plate and absorbed by the heat-absorbing portion, then the heat are transmitted to the heat sinks through the heat-dissipating portion and dissipated by the heat sinks;

two fixed arms arranged respectively on two ends of the base plate of each of the plurality of LED illumination lamp devices; and a connecting unit arranged between two adjacent LED illumination lamp devices to connect two corresponding fixed arms thereof, such that the plurality of LED illumination lamp devices are arranged in series, wherein the circuit board is composed of a first circuit board and a second circuit board, the plurality of LEDs are arranged on the first circuit board, and the driving circuit and the control circuit are arranged on the second circuit board.

7. The illumination module as claimed in claim 6, wherein each of the plurality of LED illumination lamp devices further includes a lampshade configured for covering the plurality of LEDs, the driving circuit and the control circuit on the base plate.

8. The illumination module as claimed in claim 7, wherein each of the plurality of LED illumination lamp devices further includes a waterproof gasket arranged between the lampshade and the base plate.

9. The illumination module as claimed in claim 6, wherein the circuit board is composed of the first circuit board, the second circuit board, and a third circuit board, the plurality of LEDs are arranged on the first circuit board, and the driving circuit is arranged on the second circuit board and the control circuit is arranged on the third circuit board.

10. The illumination module as claimed in claim 6, wherein the plurality of LED illumination devices are arranged in a longitudinal direction, the connecting unit having a plurality of screws and a supporting plate, the supporting plate is arranged above the plurality of fixed arms and fixed on the plurality of fixed arms.

11. The illumination module as claimed in claim 6, wherein the plurality of LED illumination devices are arranged in a transverse direction, the connecting unit having a plurality of screws and a supporting plate, the supporting plate is configured for fixing the plurality of fixed arms thereon by the plurality of screws, such that plurality of LED illumination devices are arranged in parallel.

12. The illumination module as claimed in claim 6, wherein each of the plurality of fixed arm is a Z-shaped plate.

* * * * *